US009651051B2

(12) United States Patent
Chang et al.

(10) Patent No.: US 9,651,051 B2
(45) Date of Patent: May 16, 2017

(54) SERIES FAN STRUCTURE WITH MULTISTAGE FRAME BODY

(71) Applicant: ASIA VITAL COMPONENTS CO., LTD., New Taipei (TW)

(72) Inventors: Bor-Haw Chang, New Taipei (TW); Ta-Cheng Lee, New Taipei (TW)

(73) Assignee: Asia Vital Components Co., Ltd., New Taipei (TW)

( * ) Notice: Subject to any disclaimer, the term of this patent is extended or adjusted under 35 U.S.C. 154(b) by 865 days.

(21) Appl. No.: 14/034,566

(22) Filed: Sep. 24, 2013

(65) Prior Publication Data

US 2015/0086351 A1 Mar. 26, 2015

(51) Int. Cl.
*F04D 19/00* (2006.01)
*F04D 29/60* (2006.01)

(52) U.S. Cl.
CPC ..... *F04D 19/002* (2013.01); *F04D 29/601* (2013.01)

(58) Field of Classification Search
CPC .... F04D 19/002; F04D 19/007; F04D 29/601; F04D 29/661; F04D 29/668
USPC ..... 415/68
See application file for complete search history.

(56) References Cited

U.S. PATENT DOCUMENTS 6,375,440 B2 * 4/2002 Kosugi ..... F04D 29/602 165/80.3
6,827,549 B1 * 12/2004 Horng ..... F04D 29/582 415/193
7,156,611 B2 * 1/2007 Oosawa ..... F04D 19/007 415/199.5
7,585,150 B2 * 9/2009 Hsu ..... H05K 7/20172 415/213.1
2005/0024829 A1 * 2/2005 Horng ..... F04D 19/007 361/695
2005/0260065 A1 * 11/2005 Kikuichi ..... F04D 29/601 415/60
2008/0101920 A1 * 5/2008 Yoshida ..... F04D 25/0613 415/68
2008/0286135 A1 * 11/2008 Yoshida ..... F04D 19/007 417/423.5
2009/0022587 A1 * 1/2009 Yoshida ..... F04D 19/007 415/213.1
2009/0155104 A1 * 6/2009 Takeshita ..... F04D 25/0613 417/423.5

(Continued)

*Primary Examiner* — Ninh H Nguyen
*Assistant Examiner* — Aaron R Eastman
(74) *Attorney, Agent, or Firm* — C. G. Mersereau; Nikolai & Mersereau, P.A.

(57) ABSTRACT

A series fan structure with multistage frame body includes a first main body, a second main body, a first frame and a second frame. The first main body has a first fan frame having a first opening and a second opening. The second main body is correspondingly serially connected to the first main body. The second main body has a second fan frame having a third opening and a fourth opening. The third opening corresponds to the second opening. The first frame is correspondingly serially connected to one side of the first fan frame with the first opening. The first frame and the first fan frame together define a first flow passage. The second frame is correspondingly serially connected to one side of the second fan frame with the fourth opening. The second frame and the second fan frame together define a second flow passage.

13 Claims, 5 Drawing Sheets

(56) References Cited

U.S. PATENT DOCUMENTS

2009/0214336 A1* 8/2009 Yoshida ..... F04D 19/007
415/213.1

* cited by examiner

SERIES FAN STRUCTURE WITH MULTISTAGE FRAME BODY

BACKGROUND OF THE INVENTION

1. Field of the Invention

The present invention relates generally to a series fan structure with multistage frame body, and more particularly to a series fan structure having multistage frame body for greatly enhancing vibration absorption effect.

2. Description of the Related Art

Along with the continuous advance of sciences and technologies, the reliance of peoples on various electronic apparatuses has more and more increased. In operation, the internal components of the electronic products (such as computers and laptops) will generate high heat. The heat must be dissipated to outer side of the electronic products in time. Otherwise, the problem of overheating will take place. Therefore, most of the electronic products are provided with fans disposed therein for keeping the electronic products working at an operation temperature within a range.

Please refer to FIGS. 1A and 1B. The fan frames 10 of the current series fan 1 have the same size. The fan frames 10 are assembled with a fan impeller 11, a motor (not shown), etc. to form the fan. In operation, according to the design principle of the motor torque operation, the fan frame 11 will inevitably vibrate. Especially, with respect to a series fan, when the fan impellers 11 inside the fan frames 10 operate and rotate at the same time, under the inter-affection of the vibration frequency of the fan impellers 11, the two fan frames 10 will more severely resonate under resonation effect. The resonation will be directly transmitted outward form the fan frames 10. The hard disc (such as the hard disc in a server) of the mainframe system of an electronic product is especially sensitive to vibration. However, the conventional integrally formed fan frame 10 can hardly reduce the vibration. In some more serious cases, the vibration of the motor and the fan impeller 11 will even interfere with the normal work of other electronic components. This will lead to deterioration of the performance of the system. Moreover, the resonation is always accompanied by loud noise. One of the vibration absorption methods of the conventional fan 1 is to employ vibration absorption fixing structure to achieve the vibration absorption effect. However, such vibration absorption fixing structure includes numerous components and it is complicated to manufacture these components. As a result, the manufacturing cost is relatively high.

According to the above, the conventional device has the following shortcomings:

1. The vibration can be hardly effectively reduced.
2. The vibration will make loud noise.
3. The reading efficiency of the hard disc of the system is lowered.
4. The manufacturing cost is increased.

SUMMARY OF THE INVENTION

It is therefore a primary object of the present invention to provide a series fan structure with multistage frame body having excellent vibration absorption effect.

It is a further object of the present invention to provide the above series fan structure with multistage frame body, which can lower the volume of noise.

It is still a further object of the present invention to provide the above series fan structure with multistage frame body, which can enhance the reading efficiency of the hard disc of the system.

It is still a further object of the present invention to provide the above series fan structure with multistage frame body, which is manufactured at lower cost.

It is still a further object of the present invention to provide the above series fan structure with multistage frame body, which is applicable to those fans with super-high rotational speed performance.

To achieve the above and other objects, the series fan structure with multistage frame body of the present invention includes a first main body, a second main body, a first frame and a second frame. The first main body has a first fan frame having a first opening and a second opening on two opposite sides. A first fan impeller base seat is disposed at the second opening. A first fan impeller is rotatably connected to the first fan impeller base seat. The second main body is correspondingly serially connected to the first main body. The second main body has a second fan frame having a third opening and a fourth opening on two opposite sides. The third opening corresponds to the second opening. A second fan impeller base seat is disposed at the third opening in adjacency to the first fan impeller base seat. A second fan impeller is rotatably connected to the second fan impeller base seat. The first frame is correspondingly serially connected to one side of the first fan frame with the first opening. The first and second frame openings are respectively positioned on two sides of the first frame with the second frame opening correspondingly communicating with the first opening. The first frame and the first fan frame together define a first flow passage. The first fan impeller is positioned in the first flow passage. The second frame is correspondingly serially connected to one side of the second fan frame with the fourth opening. The second frame has a third frame opening and a fourth frame opening on two sides. The third frame opening correspondingly communicates with the fourth opening. The second frame and the second fan frame together define a second flow passage. The second fan impeller is positioned in the second flow passage.

According to the above arrangement, the first main body, the first frame, the second main body and the second frame are correspondingly serially connected to form a multistage frame body. The vibration of the motors and the first and second fan impellers can be absorbed by the multistage frame body so that the vibration transmitted to the system outside the series fan is effectively reduced. In this case, the vibration absorption effect is greatly enhanced so that the reading efficiency of the hard disc of the system is greatly enhanced.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1A:
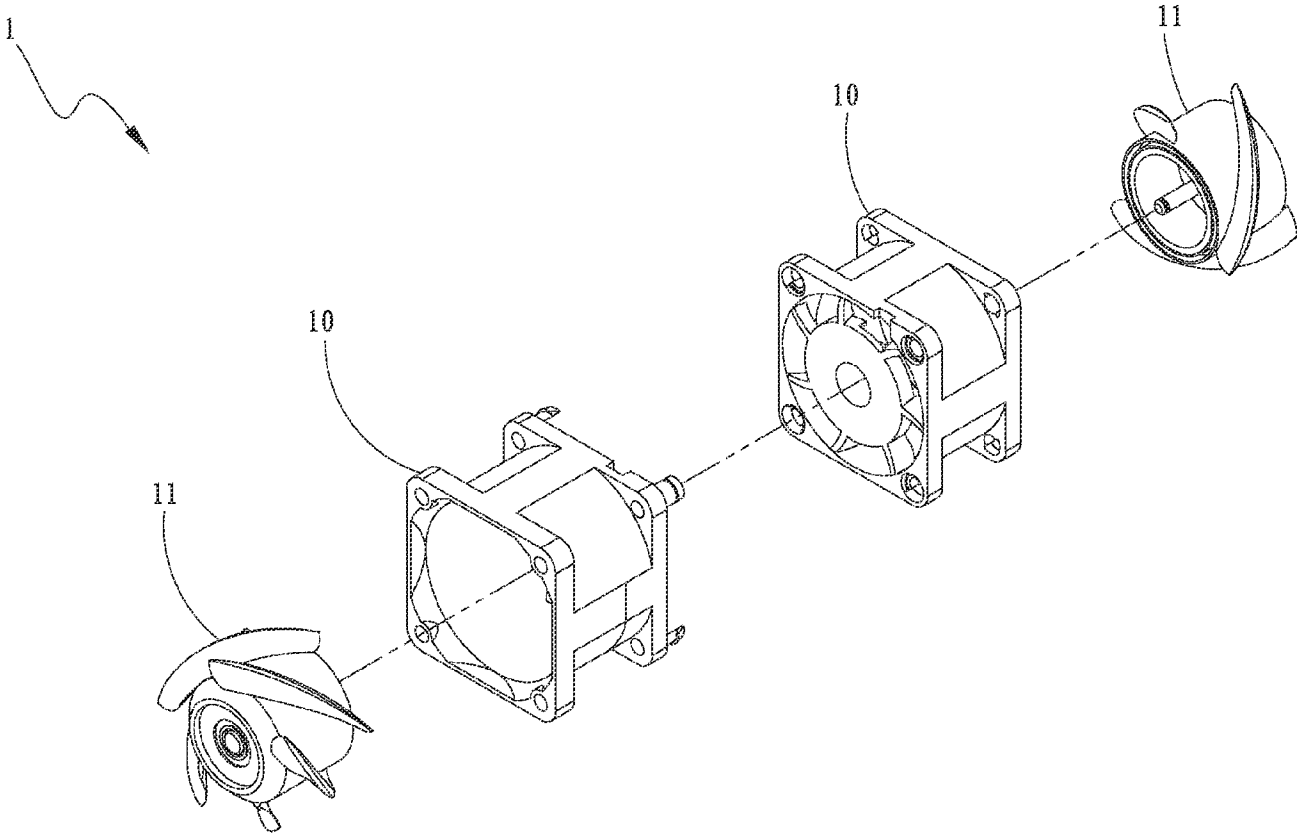
(PRIOR ART) Fig. 1A
FIG. 1A is a perspective exploded view of a conventional series fan structure.
Figure 1B:
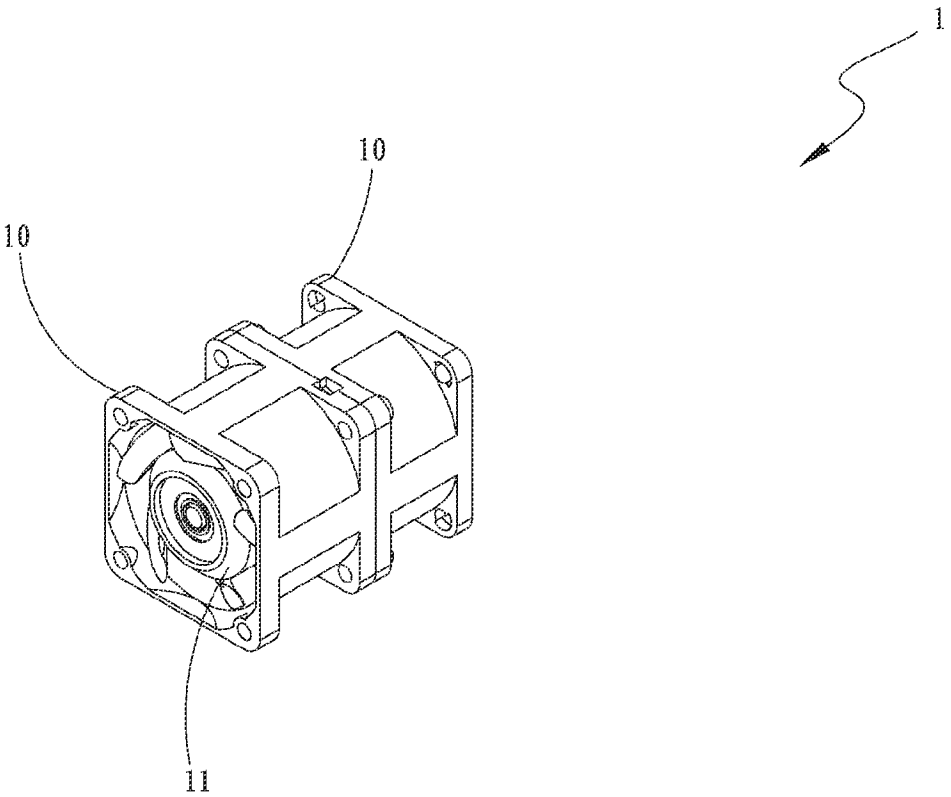
(PRIOR ART) Fig. 1B
FIG. 1B is a perspective assembled view of the conventional series fan structure.
Figure 2A:
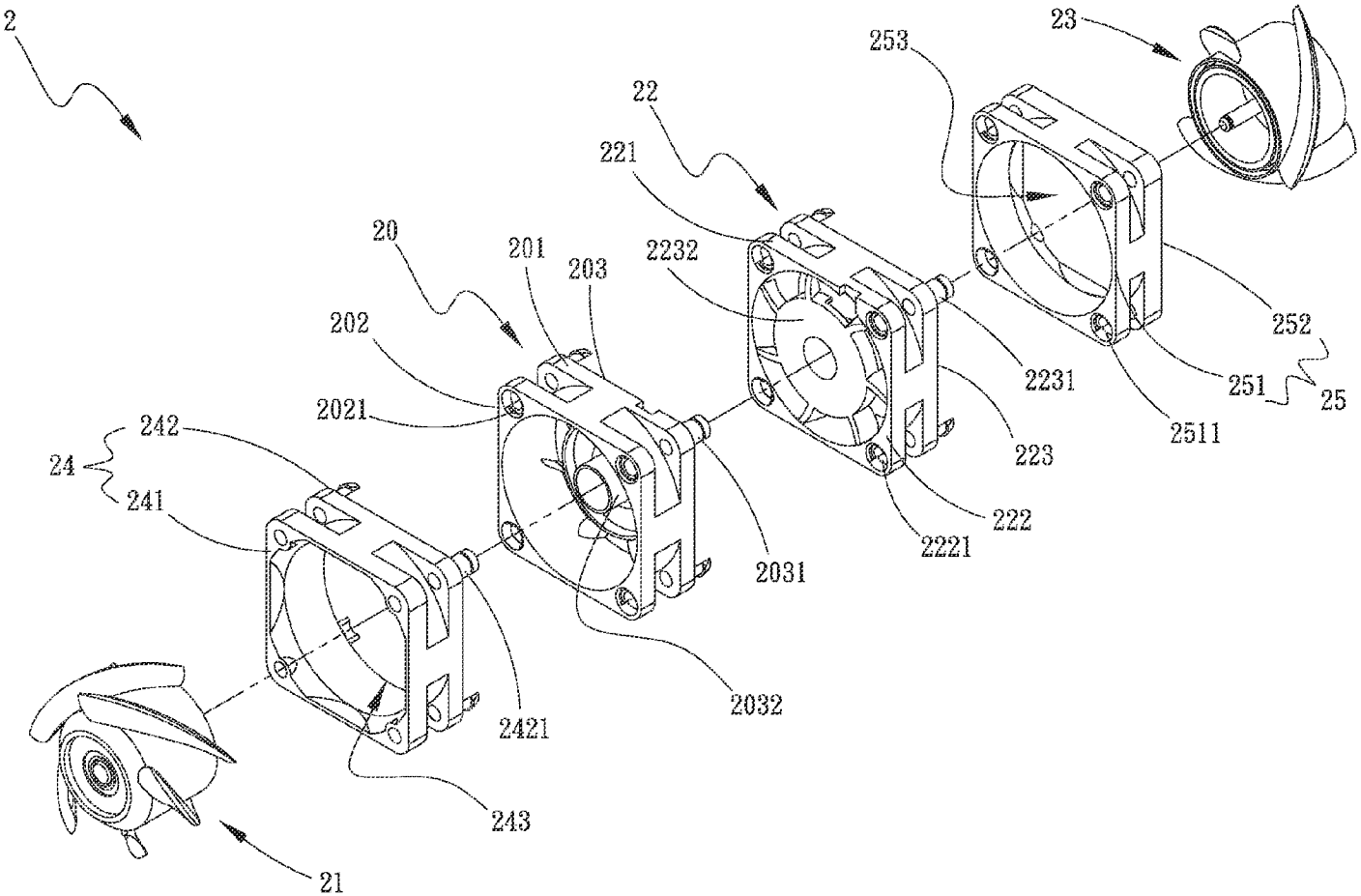
FIG. 2A is a perspective exploded view of a preferred embodiment of the series fan structure with multistage frame body of the present invention.
Figure 2B:
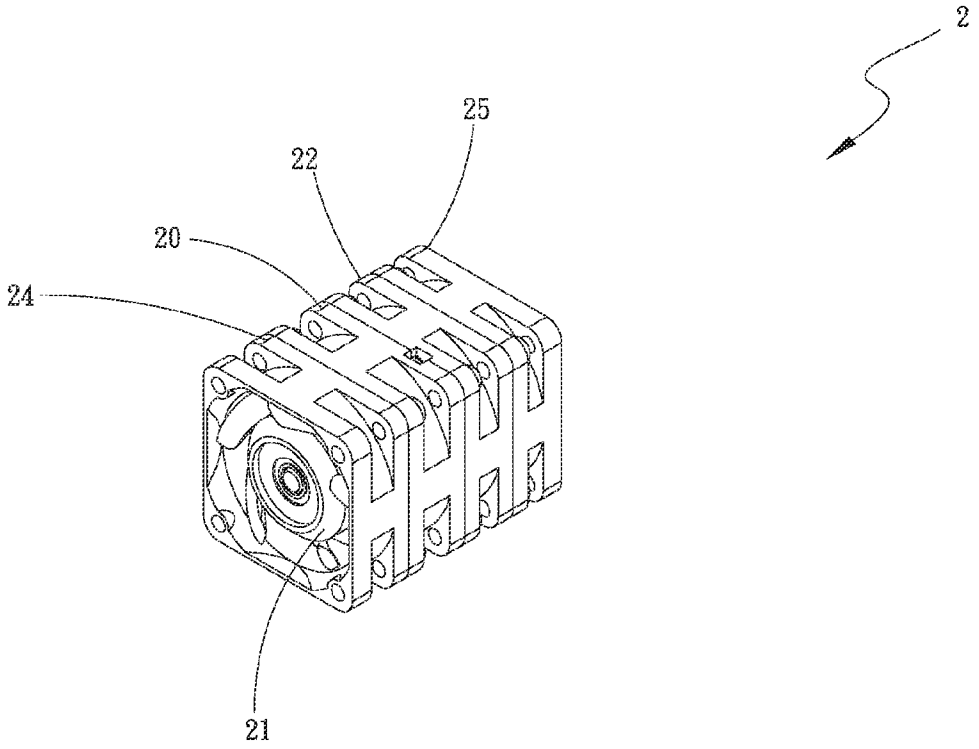
FIG. 2B is a perspective assembled view of the preferred embodiment of the series fan structure with multistage frame body of the present invention.

Please refer to FIGS. 2A and 2B. FIG. 2A is a perspective exploded view of a preferred embodiment of the series fan structure with multistage frame body of the present invention. FIG. 2B is a perspective assembled view of the preferred embodiment of the series fan structure with multistage frame body of the present invention. According to the preferred embodiment, the series fan structure 2 with multistage frame body of the present invention includes a first main body 20, a second main body 22, a first frame 24 and a second frame 25. The first main body 20 has a first fan frame 201 having a first opening 202 and a second opening 203 on two sides. A first fan impeller base seat 2032 is disposed at the second opening 203. A first fan impeller 21 is rotatably connected to the first fan impeller base seat 2032. Multiple first connection sections 2021 are formed at the first opening 202. Multiple first assembling sections 2031 are further formed at the second opening 203. The first connection sections 2021 and the first assembling sections 2031 are selected from a group consisting of holes, sockets, mortises and bosses.

The second main body 22 is correspondingly serially connected to the first main body 20. The second main body 22 has a second fan frame 221 having a third opening 222 on one side and a fourth opening 223 on the other side opposite to the third opening 222. The third opening 222 corresponds to the second opening 203. A second fan impeller base seat 2232 is disposed at the third opening 222 in adjacency to the first fan impeller base seat 2032. A second fan impeller 23 is rotatably connected to the second fan impeller base seat 2232. Multiple second assembling sections 2221 are formed at the third opening 222. Multiple second connection sections 2231 are further formed at the fourth opening 223. The second connection sections 2231 and the second assembling sections 2221 are selected from a group consisting of holes, sockets, mortises and bosses.

The first frame 24 is correspondingly serially connected to one side of the first fan frame 201 with the first opening 202. The first frame 24 has a first frame opening 241 and a second frame opening 242 opposite to the first frame opening 241. The first and second frame openings 241, 242 are respectively positioned on two sides of the first frame 24 with the second frame opening 242 correspondingly communicating with the first opening 202. The first frame 24 and the first fan frame 201 together define a first flow passage 243. The first fan impeller 21 is positioned in the first flow passage 243. Multiple first fixing sections 2421 are formed at the second frame opening 242. The first fixing sections 2421 are selected from a group consisting of holes, sockets, mortises and bosses.

The second frame 25 is correspondingly serially connected to one side of the second fan frame 221 with the fourth opening 223. The second frame 25 has a third frame opening 251 and a fourth frame opening 252 respectively positioned on two sides of the second frame 25 with the third frame opening 251 correspondingly communicating with the fourth opening 223. The second frame 25 and the second fan frame 221 together define a second flow passage 253. The second fan impeller 23 is positioned in the second flow passage 253. Multiple second fixing sections 2511 are formed at the third frame opening 251. The second fixing sections 2511 are selected from a group consisting of holes, sockets, mortises and bosses.

In the series fan structure 2 with multistage frame body of the present invention, the first assembling sections 2031 of the second opening 203 are correspondingly serially connected and assembled with the second assembling sections 2221 of the third opening 222 and the first connection sections 2021 of the first opening 202 are correspondingly serially connected and assembled with the first fixing sections 2421 of the second frame opening 242 and the second connection sections 2231 of the fourth opening 223 are correspondingly serially connected and assembled with the second fixing sections 2511 of the third frame opening 251. In this embodiment, the first main body 20 is serially connected with the second main body 22 by means of, but not limited to, engagement. In practice, the first and second main bodies 20, 22 can be serially connected with each other by means of any other securing measure such as locking, insertion, adhesion or stringing.

In this embodiment, the first main body 20 is serially connected with the first frame 24 by means of, but not limited to, engagement. In practice, the first main body 20 and the first frame 24 can be serially connected with each other by means of any other securing measure such as locking, insertion, adhesion or stringing.

In this embodiment, the second main body 22 is serially connected with the second frame 25 by means of, but not limited to, engagement. In practice, the second main body 22 and the second frame 25 can be serially connected with each other by means of any other securing measure such as locking, insertion, adhesion or stringing.

Figure 3:
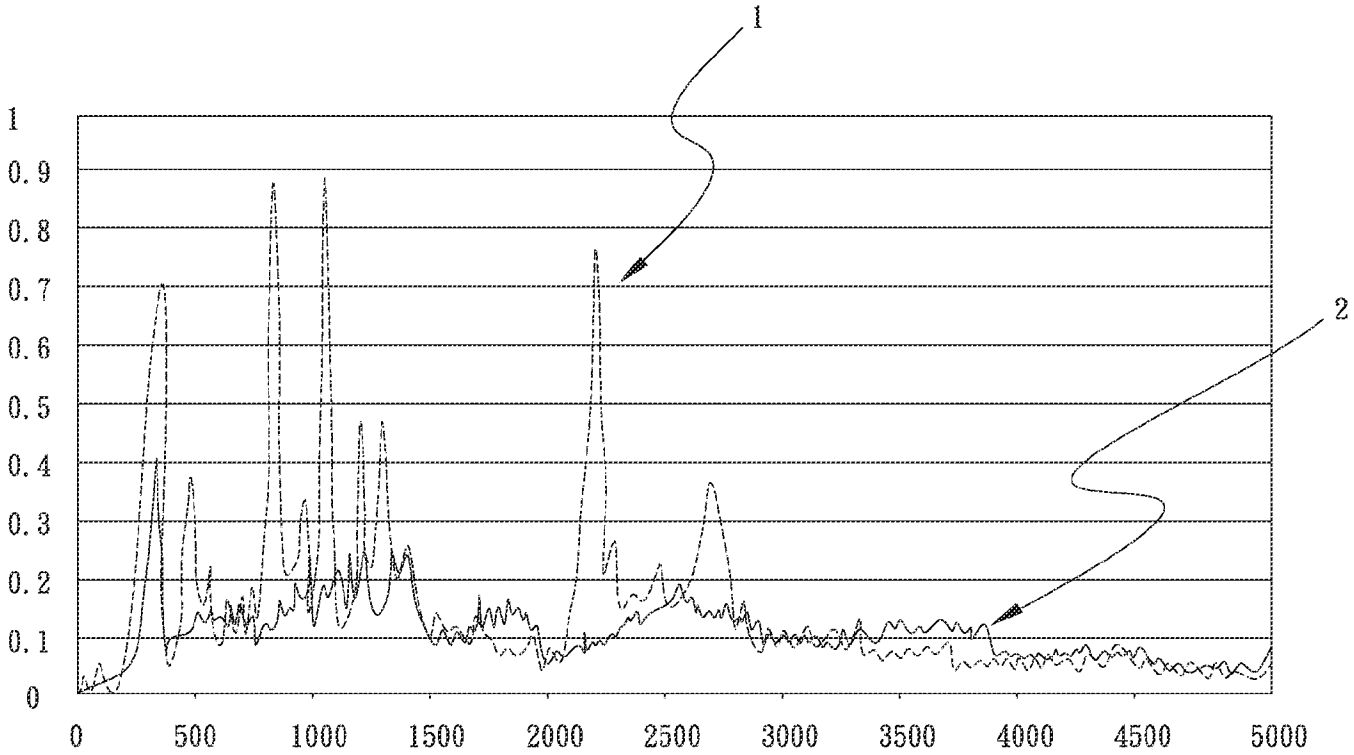
FIG. 3 is a test comparison diagram of the preferred embodiment of the series fan structure with multistage frame body of the present invention.

In operation of the series fan, the vibration or resonation of the motor (not shown), the first fan impeller 21 and the second fan impeller 23 can be absorbed by the first and second fan frames 201, 221 and the first and second frames 24, 25 to lower the noise. In this case, the vibration transmitted to the system outside the series fan is reduced. Accordingly, the vibration is reduced and the noise is lowered to greatly enhance the reading efficiency of the hard disc of the system. This can be seen from FIG. 3, which is a test comparison diagram of the preferred embodiment of the series fan structure with multistage frame body of the present invention.

Moreover, the series fan structure 2 with multistage frame body of the present invention has very good vibration absorption effect so that the present invention is applicable to those fans with super-high rotational speed performance. The series fan structure with multistage frame body of the present invention is able to overcome the problems of noise and vibration due to high rotational speed of the fan.

Also, the structural design of the present invention is free from the numerous components of the vibration absorption fixing structure of the conventional fan. Therefore, the complicated manufacturing process of these components is saved so that the manufacturing cost is lowered.

In conclusion, in comparison with the conventional device, the present invention has the following advantages:

1. The vibration absorption effect is greatly enhanced.
2. The volume of the noise is lowered.
3. The reading efficiency of the hard disc of the system is enhanced.
4. The present invention is applicable to those fans with super-high rotational speed performance.
5. The manufacturing cost is lowered.

The present invention has been described with the above embodiments thereof and it is understood that many changes and modifications in the above embodiments can be carried out without departing from the scope and the spirit of the invention that is intended to be limited only by the appended claims.

What is claimed is:

1. A series fan structure with multistage frame body, comprising:

a first main body having a first fan frame, the first fan frame having a first opening and a second opening on two opposite sides, a first fan impeller base seat being disposed at the second opening, a first fan impeller being rotatably connected to the first fan impeller base seat;

a second main body correspondingly serially and directly connected to the first main body, the second main body having a second fan frame, the second fan frame having a third opening on one side and a fourth opening on the other side, the third opening corresponding to the second opening, a second fan impeller base seat being disposed at the third opening in adjacency to the first fan impeller base seat, a second fan impeller being rotatably connected to the second fan impeller base seat;

a first frame correspondingly serially connected to one side of the first fan frame with the first opening, the first frame having a first frame opening and a second frame opening, the first and second frame openings being respectively positioned on two sides of the first frame with the second frame opening correspondingly communicating with the first opening, the first frame and the first fan frame together defining a first flow passage, the first fan impeller being positioned in the first flow passage;

a second frame correspondingly serially connected to one side of the second fan frame with the fourth opening, the second frame having a third frame opening on one side and a fourth frame opening on the other side opposite to the third frame opening, the third frame opening correspondingly communicating with the fourth opening, the second frame and the second fan frame together defining a second flow passage, the second fan impeller being positioned in the second flow passage; and wherein the first frame and the second frame can absorb a vibration which is transmitted from the first and second fan impeller base seats to the first and second openings, respectively.

2. The series fan structure with multistage frame body as claimed in claim 1, wherein the first and second main bodies are serially connected with each other by means of engagement, locking, insertion, adhesion or stringing.

3. The series fan structure with multistage frame body as claimed in claim 1, wherein the first main body and the first frame are serially connected with each other by means of engagement, locking, insertion, adhesion or stringing.

4. The series fan structure with multistage frame body as claimed in claim 1, wherein the second main body and the second frame are serially connected with each other by means of engagement, locking, insertion, adhesion or stringing.

5. The series fan structure with multistage frame body as claimed in claim 1, wherein multiple first assembling sections are formed at the second opening and multiple second assembling sections are formed at the third opening and correspondingly assembled with the first assembling sections.

6. The series fan structure with multistage frame body as claimed in claim 5, wherein the first assembling sections are selected from a group consisting of holes, sockets, mortises and bosses.

7. The series fan structure with multistage frame body as claimed in claim 5, wherein the second assembling sections are selected from a group consisting of holes, sockets, mortises and bosses.

8. The series fan structure with multistage frame body as claimed in claim 1, wherein multiple first connection sections are formed at the first opening and multiple first fixing sections are formed at the second frame opening and correspondingly connected with the first connection sections.

9. The series fan structure with multistage frame body as claimed in claim 8, wherein the first connection sections are selected from a group consisting of holes, sockets, mortises and bosses.

10. The series fan structure with multistage frame body as claimed in claim 1, wherein multiple second connection sections are formed at the fourth opening and multiple second fixing sections are formed at the third frame opening and correspondingly connected with the second connection sections.

11. The series fan structure with multistage frame body as claimed in claim 10, wherein the second connection sections are selected from a group consisting of holes, sockets, mortises and bosses.

12. The series fan structure with multistage frame body as claimed in claim 8, wherein the first fixing sections are selected from a group consisting of holes, sockets, mortises and bosses.

13. The series fan structure with multistage frame body as claimed in claim 10, wherein the second fixing sections are selected from a group consisting of holes, sockets, mortises and bosses.

* * * * *